US008984793B2

(12) United States Patent
Mirabile

(10) Patent No.: US 8,984,793 B2
(45) **Date of Patent: *Mar. 24, 2015**

(54) DISK-SHAPED BULLET, BULLET CASE AND FIREARM WITH RECTANGULAR BARREL FOR DISK-SHAPED BULLET

(71) Applicant: Nicholas F. Mirabile, North Richland Hills, TX (US)

(72) Inventor: Nicholas F. Mirabile, North Richland Hills, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/261,168

(22) Filed: Apr. 24, 2014

(65) Prior Publication Data

US 2015/0033972 A1 Feb. 5, 2015

Related U.S. Application Data

(62) Division of application No. 13/666,322, filed on Nov. 1, 2012, now Pat. No. 8,776,424.

(51) Int. Cl.

| | |
|---|---|
| ***F41A 21/00*** | (2006.01) |
| ***F42B 12/00*** | (2006.01) |
| ***F42B 30/02*** | (2006.01) |

(52) U.S. Cl.

CPC ..... *F42B 30/02* (2013.01); *F42B 12/00* (2013.01)

USPC ..... 42/76.01; 42/78; 89/14.05; 89/14.7; 124/42; 124/46

(58) Field of Classification Search

USPC ..... 42/76.01, 78; 89/14.05, 14.7; 124/42, 124/46

See application file for complete search history.

(56) References Cited

U.S. PATENT DOCUMENTS

| | | | | |
|---|---|---|---|---|
| 1,768,117 | A * | 6/1930 | Christoph | 124/17 |
| 1,818,763 | A * | 8/1931 | Shigley | 124/16 |
| 2,598,354 | A * | 5/1952 | Clauss | 124/26 |
| 2,742,889 | A * | 4/1956 | Clauss | 124/26 |
| 2,934,056 | A * | 4/1960 | Lauterbach | 124/9 |
| 2,945,236 | A * | 7/1960 | Marsh et al. | 227/8 |
| 3,515,114 | A * | 6/1970 | Carbonneau | 124/27 |
| 3,822,688 | A * | 7/1974 | Mayne | 124/6 |
| 4,170,215 | A * | 10/1979 | Kettlestrings | 124/16 |
| 4,222,361 | A * | 9/1980 | Jackson et al. | 124/5 |
| 4,659,320 | A * | 4/1987 | Rich et al. | 446/435 |
| 4,984,556 | A * | 1/1991 | Glass et al. | 124/5 |
| 5,579,748 | A * | 12/1996 | Kohl | 124/5 |
| 6,224,457 | B1 * | 5/2001 | Wu | 446/473 |
| 6,481,429 | B2 * | 11/2002 | Nishio et al. | 124/29 |

* cited by examiner

*Primary Examiner* — Michael David

(74) *Attorney, Agent, or Firm* — Lynn E. Barber

(57) ABSTRACT

A firearm is provided that includes a receiver, a stock, an elongated barrel and a muzzle. The barrel extends from the receiver to the muzzle and has a rectangular internal bore extending from the receiver to the muzzle. The internal bore has two short sides and two long sides. A plurality of teeth extends along one of the short sides within the internal bore. A disk-shaped bullet fitting within the internal bore may be fired from the firearm. A bullet case having a rectangular orifice is provided to chamber the disk-shaped bullet for propulsion through the rectangular internal bore of the firearm.

1 Claim, 13 Drawing Sheets

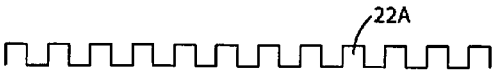
Figure 20
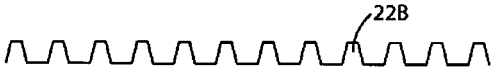
Figure 22
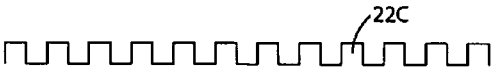
Figure 24
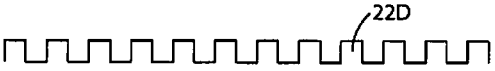
Figure 26
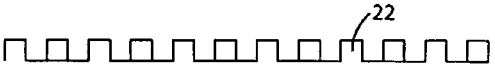
Figure 28
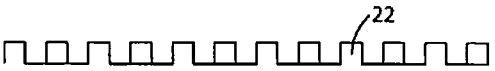
Figure 30
Figure 21
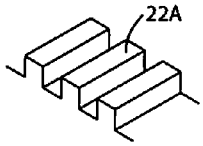
Figure 23
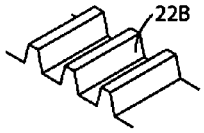
Figure 25
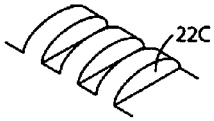
Figure 27
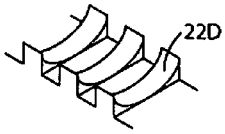
Figure 29
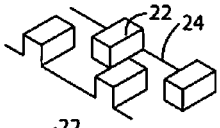
Figure 31
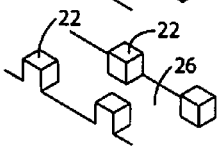

DISK-SHAPED BULLET, BULLET CASE AND FIREARM WITH RECTANGULAR BARREL FOR DISK-SHAPED BULLET

BACKGROUND OF THE INVENTION

1. Field of the Invention

This invention relates generally to firearms and guns such as rifles and to the bullets propelled therefrom, and in particular relates to a firearm having a rectangular barrel for shooting a disk-shaped bullet and to a disk-shaped bullet and cartridge for use with the firearm.

2. Description of the Related Art

There are many different types of firearms used for sporting, military or other activities, primarily having in common that a projectile (e.g., a bullet or ball) is propelled by some means away from the firearm through a barrel. Propulsion upon discharge of the firearm is accomplished by means such as gunpowder alone, a percussion cap plus gunpowder or a cartridge containing primer (impact sensitive chemical mixture), gunpowder and bullet. Ignition of the gunpowder, usually within the cartridge casing, causes a sudden formation of gas which propels the projectile out the barrel.

Early firearms used simple, spherical bails as bullets, typically made of lead and having diameters sized to fit closely in the cylindrical barrels of the firearms. In the early 1800's pointed bullets having a conical front end were developed. Typically they had a hollow rear end with some structural component designed to grip and engage rifling within the barrel. Whatever the structure, it is important that bullets are manufactured without problematic surface imperfections and that they form a seal with the bore of the firearm so that gas does not leak past the bullet, reducing the efficiency of the firearm. The bullet must also engage rifling within the firearm barrel without damaging or fouling the bore of the firearm and without distorting the bullet.

Most firearms designed to discharge a single projectile at a time typically have a bullet guide feature known as "rifling". The process of rifling provides lands with interleaved helical ("spiral") grooves within the barrel of a round-bored firearm, generally with two or more grooves cut or milled throughout the length of the barrel. The diameter of the projectile or bullet that is fired through the barrel corresponds with the groove diameter. The rifling causes the projectile to spin and become gyroscopically stabilized. The projectile is then aerodynamically stabilized and has increased accuracy. The "twist rate" of rifling defines the distance the projectile moves within the barrel to complete one full revolution. The shorter the distance, the greater (faster) the twist rate, so that the projectile is rated at a faster spin rate. For spherical lead balls, only a low twist rate (e.g., 1 turn in 48 inches) is used, while barrels used with long narrow bullets have faster twist rates (e.g., 1 turn in 8 inches). The twist rate may increase within the barrel. Generally, firearm barrels have rifling that provides a twist rate to stabilize the type of projectile for which the firearm is typically used. An alternative bullet guide feature is provided by the patent of Hagan (U.S. Pat. No. 3,777,385) and comprises a plurality of adjacent aperture disc assemblies fitted within the cylindrical barrel.

Rifle cartridges are designed to work with particular interior bore dimensions of the gun chamber. A cartridge holds the bullet, propellant and primer, usually within a case (e.g., of metal) that fits precisely within the firing chamber of a firearm.

It is an object of the invention to provide a firearm, bullet case and bullet providing increased stability when the firearm is fired.

It is a further object of the invention to provide a firearm having a barrel with a rectangular bore and a bullet case and disk-shaped bullets for use with the firearm.

It is a further object of the invention to provide a disk-shaped bullet that is compact and thin for high capacity storage and magazine loading.

It is a further object of the invention to provide a bullet that has greater penetration, similar to a rotating circular blade, with greater surface edge.

Other objects and features of the inventions will be more fully apparent from the following disclosure and appended claims.

SUMMARY OF THE INVENTION

The invention herein includes a firearm comprising a receiver, a stock, an elongated barrel and a muzzle. The barrel extends from the receiver to the muzzle and has a rectangular internal bore extending from the receiver to the muzzle. The internal bore has two short sides and two long sides. A plurality of teeth extends along one of the short sides within the internal bore. A disk-shaped bullet fitting within the internal bore may be fired from the firearm. A bullet case having a rectangular orifice is provided to chamber the disk-shaped bullet for propulsion through the rectangular internal bore of the firearm.

Other objects and features of the inventions will be more fully apparent from the following disclosure and appended claims.

BRIEF DESCRIPTION OF THE DRAWINGS

FIG. 20 is a schematic side-view of flat/straight (rectangular) teeth.

FIG. 21 is a perspective view of the teeth of FIG. 20.

FIG. 22 is a schematic side-view of flat angled teeth.

FIG. 23 is a perspective view of the teeth of FIG. 22.

FIG. 24 is a schematic side-view of convex teeth.

FIG. 25 is a perspective view of the teeth of FIG. 24.

FIG. 26 is a schematic side-view of concave teeth.

FIG. 27 is a perspective view of the teeth of FIG. 26.

FIG. 28 is a schematic side-view of off-set flat, straight teeth.

FIG. 29 is a perspective view of the teeth of FIG. 28.

FIG. 30 is a schematic side-view of off-set teeth with a central channel.

FIG. 31 is a perspective view of the teeth of FIG. 30.

DETAILED DESCRIPTION OF THE INVENTION AND PREFERRED EMBODIMENTS THEREOF

The present invention comprises a firearm with a barrel having a rectangular internal bore with teeth extending along one short side of the rectangular internal bore, a disk-shaped bullet (or "penny bullet") and a bullet case as described and shown herein.

Figure 18:
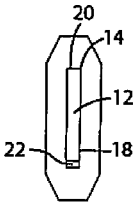
FIG. 18 is a muzzle-end view of the rectangular teething barrel of FIG. 16.
Figure 19:
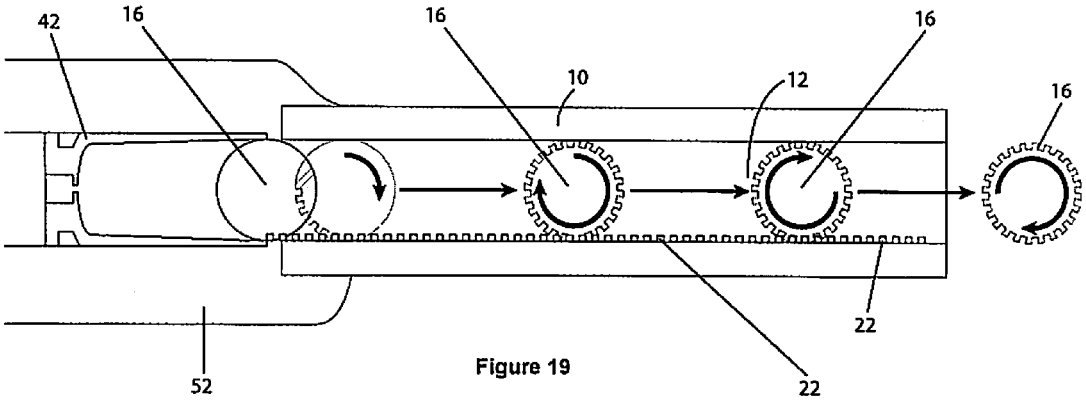
FIG. 19 shows the rectangular teething barrel of FIG. 16 and a side cross-sectional schematic view of sequential positions of a disk-shaped bullet being fired through the teething barrel.
Figure 35:
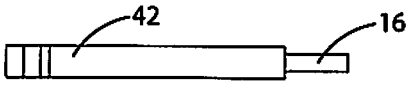
FIG. 35 is top plan view of the bullet case of FIG. 32.
Figure 36:
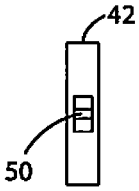
FIG. 36 is a back elevational view of the bullet case of FIG. 32 (also shows the back elevational view of the bullet case of FIG. 37 and FIG. 41).
Figure 33:
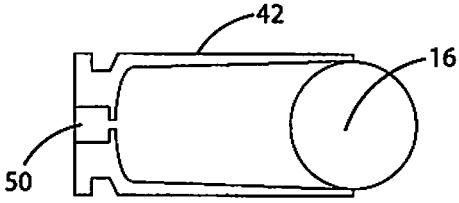
FIG. 33 is a side cross-sectional view of the bullet case of FIG. 32.
Figure 34:
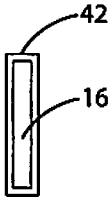
FIG. 34 is a front elevational view of the bullet case of FIG. 32.
Figure 32:
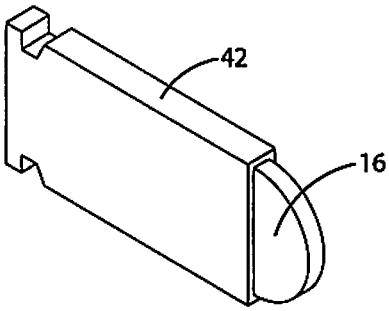
FIG. 32 is a front side perspective view of a primer center-fired, straight bullet case with no shoulder and no neck.
Figure 40:
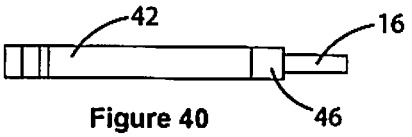
FIG. 40 is a top plan view of the bullet case of FIG. 37.
Figure 38:
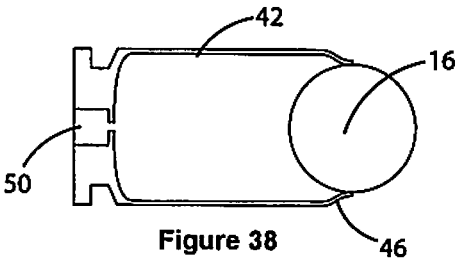
FIG. 38 is a side cross-sectional view of the bullet case of FIG. 37.
Figure 39:
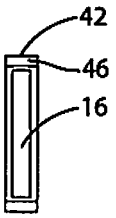
FIG. 39 is a front elevational view of the bullet case of FIG. 37 (also shows the front elevational view of the bullet case of FIG. 41).
Figure 37:
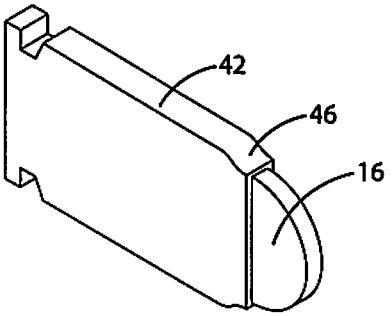
FIG. 37 is a front side perspective view of a primer center-fired, sloped shoulder bullet case with no neck.

The firearm with which the invention is used comprises a receiver and a stock as known in the art (not shown) and an elongated barrel 10. The elongated barrel 10 of the invention has an internal bore 12 having a rectangular cross-section 14 as shown in FIG. 18 to accommodate the disk-shaped bullet 16 (discussed below). In an example of a preferred embodiment of the invention components herein, the internal bore 12 is ½ inch×3/16 inch as is the rectangular orifice 44 of the bullet case 42 (see below), and the disk-shaped bullet 16 is about 0.001 inch larger in each dimension than is the internal bore 12. The disk-shaped bullet 16 touches the internal bore 12 on all sides of the disk-shaped bullet 16 as is the case for prior art bullets and barrels. The disk-shaped bullet 16 compresses as it goes over the teeth 22, and as shown in FIG. 19, has an edge similar to a saw blade after progressing down the elongated barrel 10.

Figure 1:
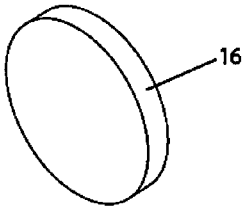
FIG. 1 is a perspective view of a first embodiment of the disk-shaped bullet of the invention.
Figure 2:
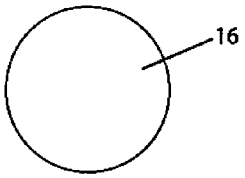
FIG. 2 is an elevational view of a side the disk-shaped bullet of FIG. 1.
Figure 3:
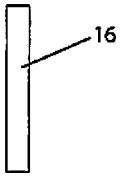
FIG. 3 is an elevational view of an edge of the disk-shaped bullet of FIG. 1.
Figure 4:
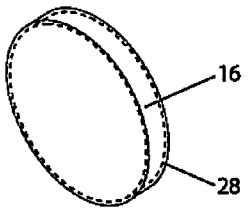
FIG. 4 is a perspective view of a first embodiment of the disk-shaped bullet of the invention having a coating (dashes).
Figure 5:
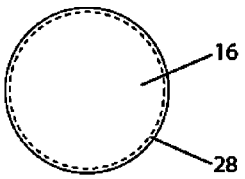
FIG. 5 is an elevational view of a side of the disk-shaped bullet of FIG. 4.
Figure 6:
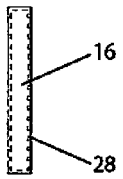
FIG. 6 is an elevational view of an edge of the disk-shaped bullet of FIG. 4.
Figure 7:
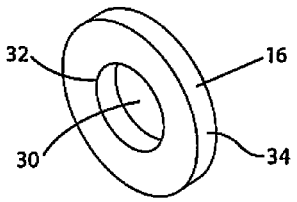
FIG. 7 is an elevational view of a second embodiment of the disk-shaped bullet of the invention.
Figure 8:
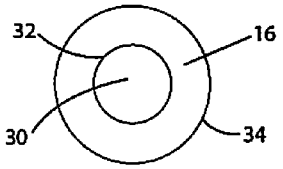
FIG. 8 is an elevational view of a side of the disk-shaped bullet of FIG. 7.
Figure 9:
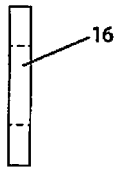
FIG. 9 is an elevational view of an edge of the disk-shaped bullet of FIG. 7.
Figure 10:
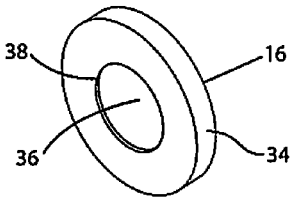
FIG. 10 is a perspective view of a third embodiment of the disk-shaped bullet of the invention having a central indentation on the sides.
Figure 11:
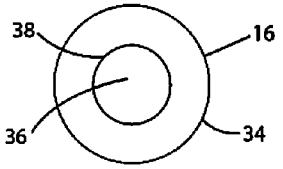
FIG. 11 is an elevational view of a side of the disk-shaped bullet of FIG. 10.
Figure 12:
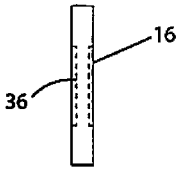
FIG. 12 is an elevational view of an edge of the disk-shaped bullet of FIG. 10.
Figure 13:
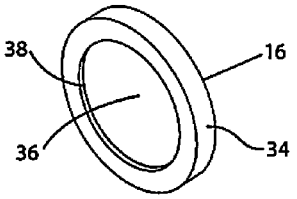
FIG. 13 is a perspective view of the third embodiment of the invention having a larger central indentation than on FIG. 10.
Figure 14:
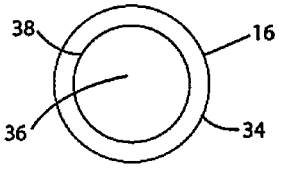
FIG. 14 is an elevational view of a side of the disk-shaped bullet of FIG. 13.
Figure 15:
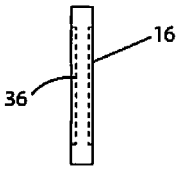
FIG. 15 is an elevational view of an edge of the disk-shaped bullet of FIG. 13.
Figure 17:
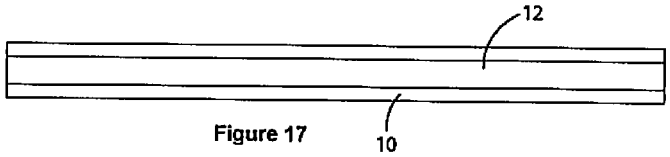
FIG. 17 is a top view of the rectangular teething barrel of FIG. 16. This figure also illustrates the appearance of a side view of a horizontal teething barrel.
Figure 16:
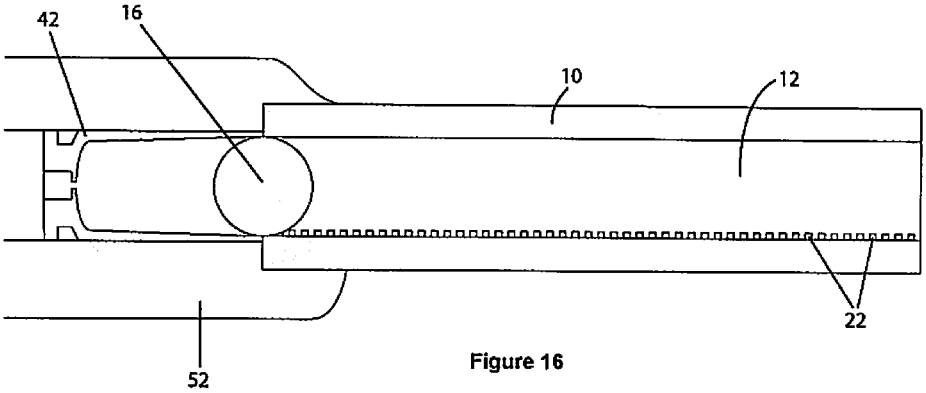
FIG. 16 is a side cross-sectional view of a rectangular teething barrel (and a portion of the rest of the rifle) in a vertical configuration, showing a disk-shaped bullet in a bullet case in the gun chamber. This figure also illustrates the appearance of a top view of a horizontal teething barrel.

The barrel 10 may be mounted on a receiver of a rifle as known in the art, in a vertical configuration (FIGS. 16-18). Alternatively, the barrel 10 may be shifted 90° to a horizontal configuration (FIG. 16 shows what the top of a vertical configuration would look like and FIG. 17 shows what a side of a vertical configuration would look like) or a diagonal position (not shown). Preferably the outside of the barrel 10 is rectangular. Multiple elongated barrels, each having a rectangular internal bore, may be mounted together, for example, stacked aligned side-by-side or stacked, to create multi-barrel, single-shot, multi-projectile configurations and are included in the invention herein.

In the invention herein, teething within the barrel 10 comprising multiple teeth 22, replaces the rifling that is known in the art in a rifled barrel. When a disk-shaped bullet 16 is shot out of the teething barrel 10 of the invention, it rotates as it comes out of the barrel 10, which is accomplished with the teeth 22, which are regularly spaced projections extending down one of the short sides 20 of the internal bore 12 and projecting into the internal bore 12, preferably about 0.004 inch into the internal bore 12 from one of the short sides 20. Thus, within the internal bore 12 are a plurality of teeth 22 preferably extending the length of the barrel 10, and at a minimum extending down a barrel 10 that has an internal bore 12 that is a least as long as a distance equal to the outer circumference of the disk-shaped bullet 16 of the invention (see below). The teething provides symmetry to the disk-shaped bullet 16 for flight. The teething pattern acts as a horizontal straight gear running along the length of the barrel 10, parallel to the path of the disk-shaped bullet of the invention. The purpose of the teething is to create a rotation of the disk-shaped bullet 16 when the disk-shaped bullet 16 is shot through the rectangular internal bore 12 of the barrel 10 of the invention. The teeth 22 help to accelerate rotation so as to stabilize the disk-shaped bullet 16 as it flies down the barrel 10 and to stabilize the disk-shaped bullet 16 in flight. This creates an orbital resonance so that the disk-shaped bullet 16 does not deflect from its intended path. Teeth 22 can be present at the top or bottom of a vertically oriented barrel 10 that has the shorter sides 20 of the rectangular cross-section 14 on the top and the bottom of the barrel 10, or at the left or right of a horizontally oriented barrel 10 that has the shorter 20 sides of the rectangular cross-section 14 on the left and right of the barrel 10, but never are there teeth on both shorter sides 20 of the internal bore 12 of the barrel 10 or on the longer sides 18 of the internal bore 12 of the barrel 10.

The teeth 22 which make up the teething of the invention herein may be in any shape as desired. Examples are shown of flat/straight (rectangular) teeth 22A (FIGS. 20-21), flat, angled teeth 22B (FIGS. 22-23), convex teeth 22C (FIGS. 24-25), and concave teeth 22D (FIGS. 26-27). Teeth 22 may also be pointed (not shown). Teeth 22 along the barrel 10 may also be spaced in an off-set pattern 24 (FIGS. 28-29) and/or have a center space or channel 26 (FIGS. 30-31).

Figure 59:
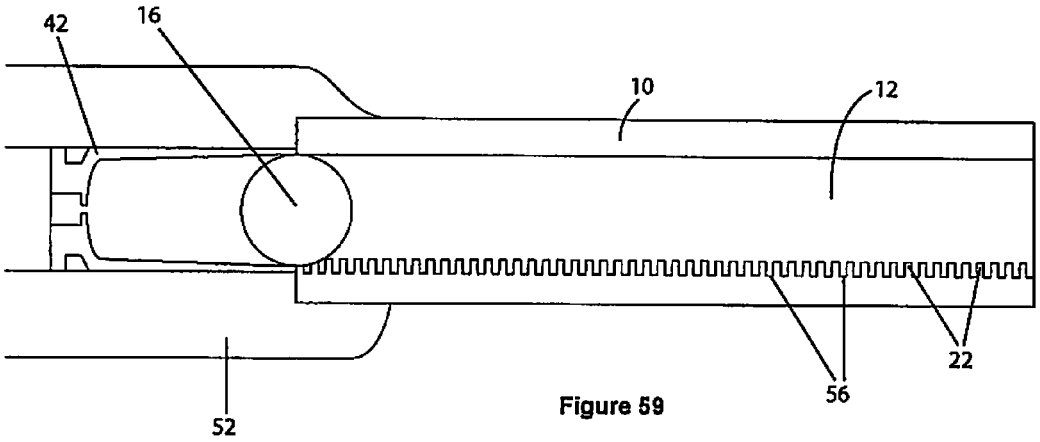
FIG. 59 is a side cross-sectional view of a rectangular teething barrel (and a portion of rest of the rifle) in a vertical configuration, showing a disk-shaped bullet in a bullet case in the gun chamber. In this embodiment, there are grooves between the teeth.

Optionally, there may be grooves 56 between teeth 22 as shown in FIG. 59. These grooves 56 mean that in the grooved barrel, the teeth 22 in the preferred embodiment extend about 0.002 inch above the mean barrel dimension and the groove 56 extends about 0.002 inch below the mean barrel dimension, and the mean barrel dimension is 0.002 inch greater in the embodiment shown in FIG. 59 than in the embodiment shown in FIG. 16.

The disk-shaped bullet 16 of the invention herein is a thin circular object, referred to herein as a "disk" (or "disc"; also called a "penny bullet") as shown in FIGS. 1-15. The disk-shaped bullet 16 is preferably made of any substance softer than that of the barrel 10, such as copper, or a copper coating 28, with lead, carbide or steel inside as known in the art.

In a first embodiment, the disk-shaped bullet 16 of the invention is coin-shaped (called a "penny bullet") as shown in FIGS. 1-6 and does not have any central indentation or hole. In a second embodiment, the disk-shaped bullet 16 of the invention is shaped like a flat washer, which may have a centrally located interior hole 30 (FIGS. 7-9), the edges 32 of the interior hole 30 being equidistant from the bullet outer edge 34 all around the interior hole 30. In a third embodiment, the disk-shaped bullet 16 of the invention has a centrally located interior, preferably but not necessarily flat, circular indentation 36 (FIGS. 10-15), with the outer edge 38 of the indentation 36 being equidistant from the bullet outer edge 34 as shown with a smaller (FIGS. 10-12) or a larger (FIGS. 13-15) indentation. A disk-shaped bullet with a larger diameter indentation 36 has less friction going down the teethed barrel 10 of the invention herein than does one with a smaller diameter indentation 36.

In any of the disk-shaped bullet embodiments, the outer edge of the disk-shaped bullet 16 may be tapered or rounded without departing from the invention herein, or be squared off as shown in the figures. A flat edge disk-shaped bullet penetrates a target in the manner of a blunt-nosed bullet as known in the art, whereas as taper-edged disk-shaped bullet has the same effect as a serrated buzz saw blade or a meat slicer or other rotating cutter. The dashed line around the edges of the disk-shaped bullet 10 in FIGS. 4-6 indicates that the disk-shaped bullet may have an exterior coating layer 28, for example, made of copper as known in the art of bullet manufacture. This coating 28 may be placed on any of the embodiments of the disk-shaped bullet of the invention herein, although is only shown on the first embodiment.

In one preferred embodiment, the disk-shaped bullet, of the invention has a circumference of approximately 1.57 inches (½ inch diameter). This is 7.743 rotations per linear foot (12 inches divided by 1.57). At 1,000 feet per second, that is 7,643 rotations per second.

The bullet case 42 of the invention may be made in the design of the cartridge of a long range rifle, a pistol or a revolver. The bullet case 42 chambers like cartridges as known in the art, for example, in the chamber 52 for a traditional rifle, semi-automatic, automatic, revolver or pistol, but only a disk-shaped bullet as provided in the invention herein can be fired from the bullet case 42 through the rectangular bore of the invention herein.

Figure 43:
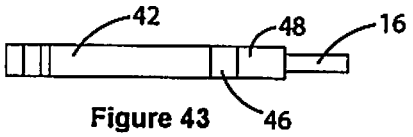
FIG. 43 is a top plan view of the bullet case of FIG. 41.
Figure 42:
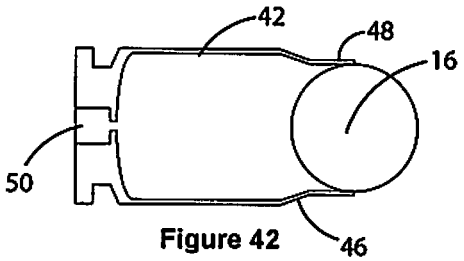
FIG. 42 is a side cross-sectional view of the bullet case of FIG. 41.
Figure 41:
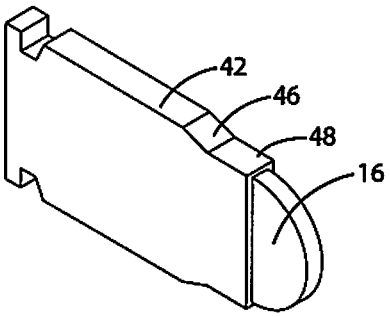
FIG. 41 is a front side perspective view of a primer center-fired bullet case having a shoulder and neck.
Figure 47:
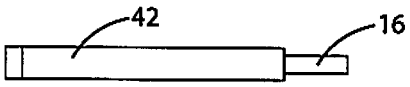
FIG. 47 is a top plan view of the bullet case of FIG. 44.
Figure 48:
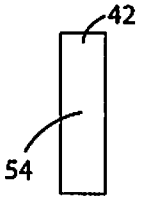
FIG. 48 is a back elevational view of the bullet, case of FIG. 44 (also shows the back elevational view of the bullet case of FIG. 49 and FIG. 53).
Figure 45:
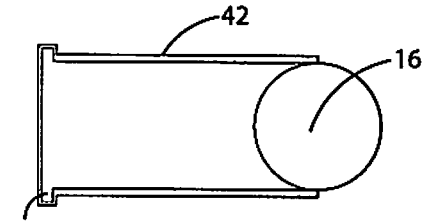
FIG. 45 is a side cross-sectional view of the bullet case of FIG. 44.
Figure 46:
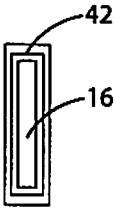
FIG. 46 is a front elevational view of the bullet case of FIG. 44.
Figure 44:
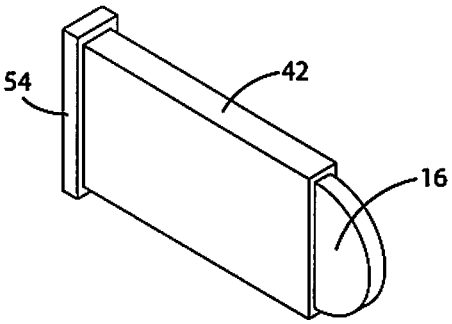
FIG. 44 is a front side perspective view of a rim-fired, straight bullet case with no shoulder and no neck.
Figure 52:
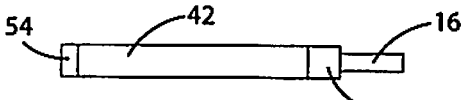
FIG. 52 is a top plan view of the bullet case of FIG. 49.
Figure 50:
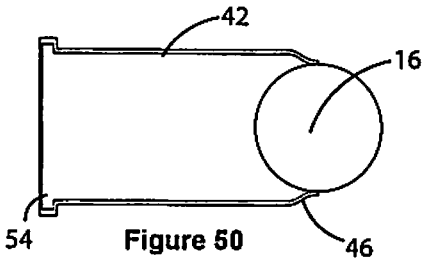
FIG. 50 is a side cross-sectional view of the bullet case of FIG. 49.
Figure 51:
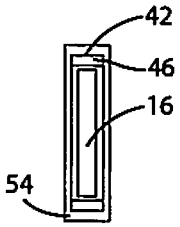
FIG. 51 is a front elevational view of the bullet case of FIG. 49 (also shows the front elevational view of the bullet case of FIG. 53).
Figure 49:
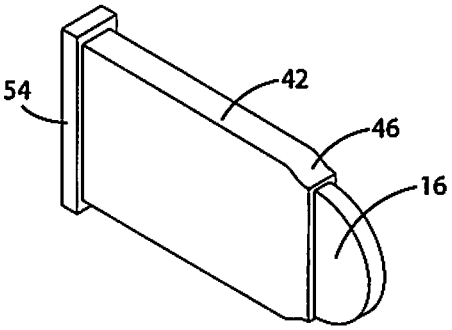
FIG. 49 is a front side perspective view of a rim-fired bullet case with a sloped shoulder and no neck.
Figure 55:
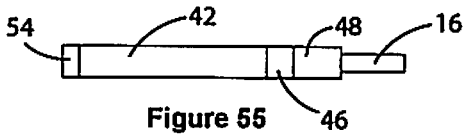
FIG. 55 is a top plan view of the bullet case of FIG. 53.
Figure 54:
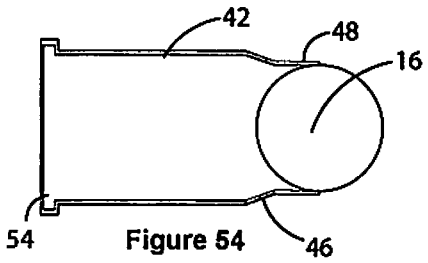
FIG. 54 is a side cross-sectional view of the bullet case of FIG. 53.
Figure 53:
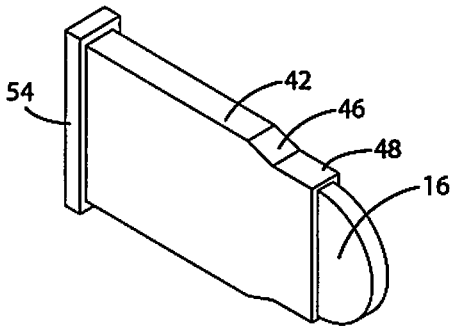
FIG. 53 is a front side perspective view of a rim-fired bullet case with a shoulder and neck.

The bullet case 42 of the invention has a rectangular orifice (slot) 44 which holds to the disk-shaped bullet 16 of the invention as shown in FIGS. 32, 37, 41, 44, 49, and 53. The bullet case 42 may be structured in a wide variety of shapes with or without a shoulder 46 and with or without a neck 48 as known in the art for particular firearms and desired uses (e.g., desired burn rate and ignition characteristics). The bullet case 42 may be primer center-fired 50 or rim-fired 54 as its ignition method as known in the art. Preferred embodiments of the bullet case 42 include but are not limited to primer center-fired, straight with no shoulder and no neck (FIGS. 32-36), primer center-fired, sloped shoulder 46, no neck (FIG. 37-40), primer center-fired with shoulder 46 and neck 48 (FIGS. 41-43), rim-fired, straight no shoulder, no neck (FIGS. 44-48), rim-fired, sloped shoulder 46, no neck (FIGS. 49-52) and rim-fired with shoulder 46 and neck 48 (FIGS. 53-55). The inside of the bullet case will have a different shape depending on the method of ignition. If the bullet case is rim-fired, it should have two firing pins as known in the art to give positive ignition.

As shown in FIGS. 33, 38, 42, 45 and 50, for proper crimping to hold the disk-shaped bullet 16 in the bullet case 42, the interior dimensions of the bullet case 42 are smaller than the external dimensions of the disk-shaped bullet 42. In use, the disk-shaped bullet is seated in the bullet case 42 by a seating die or tool as known in the art. Preferably at least half the circumference is inside the bullet case and half of it is outside the bullet case. FIG. 19 shows a schematic view of the travel of a disk-shaped bullet 16 down the teething barrel 10 of the invention and shows the tooth-caused deformation of the disk-shaped bullet 16

Figure 57:
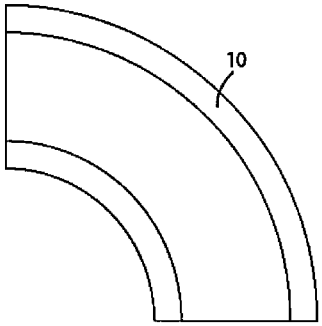
FIG. 57 is a front (end) elevational view of the teething barrel of FIG. 56.
Figure 56:
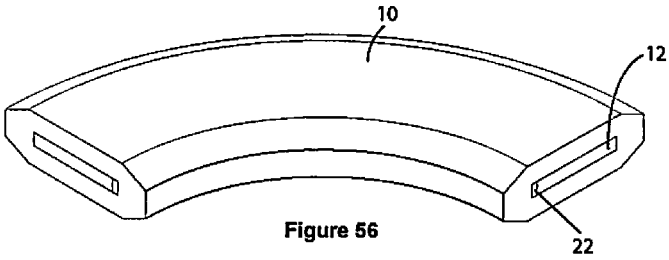
FIG. 56 is a side perspective view of rectangular teething barrel having a horizontal curved configuration.
Figure 58:
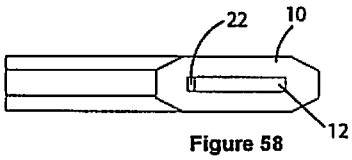
FIG. 58 is a top plan view of the teething barrel of FIG. 56.

As shown in FIGS. 56-58, the elongated barrel with rectangular bore of the invention may be curved (up to 90 degrees) to allow "around-corner" shooting of a disk-shaped bullet. The teeth 22 are shown in FIGS. 56 and 58 on the inside of the curved barrel 10, but may alternatively be on the opposite (outside) of the curved barrel 10 (not shown). In this embodiment, the disk-shaped bullet 16 initially travels on its side (horizontally) directly away from the shooter, but is turned by the curve of the barrel to exit an angle to a side of the shooter, sideways when the barrel is horizontally placed as shown in FIG. 56.

While the invention has been described with reference to specific embodiments, it will be appreciated that numerous variations, modifications, and embodiments are possible, and accordingly, all such variations, modifications, and embodiments are to be regarded as being within the spirit and scope of the invention.

What is claimed is:

1. A bullet configured for use with a firearm having a rectangular internal bore having two short sides and two long sides, the internal bore having a plurality of teeth along the internal bore along one of the short sides, the bullet comprising a coin-shaped disk having a diameter so that the bullet fits sufficiently snugly within the internal bore of the barrel so that when the bullet is fired from the firearm, the bullet obtains rotation due to the teeth in the internal bore.

* * * * *